US005720016A

United States Patent [19]

Egashira

[11] Patent Number: 5,720,016

[45] Date of Patent: Feb. 17, 1998

[54] MULTI-WINDOW DISPLAY APPARATUS FOR MANAGING WRITING FRAME MEMORY

[75] Inventor: Shinji Egashira, Yokohama, Japan

[73] Assignee: Fujitsu Limited, Kanagawa, Japan

[21] Appl. No.: 821,031

[22] Filed: Mar. 20, 1997

Related U.S. Application Data

[63] Continuation of Ser. No. 334,073, Nov. 4, 1994, abandoned.

[30] Foreign Application Priority Data

Mar. 17, 1994 [JP] Japan ..... 6-047403

[51] Int. Cl.[6] ..... C06F 15/00

[52] U.S. Cl. ..... 395/117; 395/340; 395/342

[58] Field of Search ..... 395/117, 119, 395/115, 101, 326, 339, 340, 105, 116, 342

[56] References Cited

U.S. PATENT DOCUMENTS

| | | | |
|---|---|---|---|
| 4,769,762 | 9/1988 | Tsujido | 364/521 |
| 4,825,436 | 4/1989 | Kobayashi et al. | 370/102 |
| 4,845,436 | 7/1989 | Kobayashi et al. | 328/14 |
| 4,882,578 | 11/1989 | Minakuchi | 340/750 |
| 5,142,620 | 8/1992 | Watanabe et al. | 395/164 |
| 5,438,376 | 8/1995 | Watanabe | 348/714 |
| 5,448,694 | 9/1995 | Wada et al. | 395/152 |
| 5,479,605 | 12/1995 | Saitoh | 395/164 |

*Primary Examiner*—Raymond J. Bayerl
*Assistant Examiner*—Steven P. Sax
*Attorney, Agent, or Firm*—Staas & Halsey

[57] ABSTRACT

A multi-window display apparatus has a writing frame memory, a display frame memory, an image transfer portion and a display. The image transfer portion copies window data in a cell to the display frame memory. The display displays the window data copied in the display frame memory. A division table stores data indicating a number of divisions and a maximum size of each cell when the writing frame memory is divided into the specified number of divisions. A status table stores a current number of divisions and a number of cells in use. A cell table stores data indicating, for each cell, an identifier, the size of the window existing in the cell, and the location of the cell in the writing frame memory. A window managing portion responds to a window acquisition request as follows. When the number of cells currently in use is less than the current number of divisions, the window managing portion updates the number of cells used in the status table, selects a vacant cell and updates the size in the cell data table for the selected vacant cell under the condition that a designated size in the window acquisition request is equal to or smaller than the maximum size of the current number of divisions. When the number of cells currently used is not less than the current number of divisions, the window managing portion updates the number of divisions of the status table, updates the number of cells used in the status table, selects a vacant cell and updates the size in the cell data table for the selected vacant cell under the condition that the designated size of the window acquisition request and sizes of all windows already acquired are less than the maximum size of the next largest number of divisions.

14 Claims, 9 Drawing Sheets

| ID | WIDTH | HEIGHT | POSITION A | POSITION B |
|---|---|---|---|---|
| WIN-1 | 1000 | 5000 | (0, 0) | (200, 100) |
| WIN-2 | 700 | 300 | (1000, 0) | (800, 400) |
| WIN-3 | 400 | 400 | (0, 500) | (1300, 600) |

CPU
8
7 WINDOW CONTROL TABLE
71
72
73
DIV
STATUS
CELL
WINDOW ACQUISITION/
RESIZE/RELEASE
WINDOW
MANAGING
PORTION
20
WINDOW
ACQUISITION
PORTION
21
WINDOW
RESIZE
PORTION
22
WINDOW
RELEASE
PORTION
23
1
FIGURE DATA
WRITING
PORTION
3
IMAGE
TRANSFER
4
WRITING
FRAME
MEMORY
5
DISPLAY
FRAME
MEMORY
6
CRT

FIG. 5

71

| DIVISION NUMBER | MAXIMUM SIZE |
|---|---|
| 1 | 2048 x 1024 |
| 2 | 1024 x 1024 |
| 4 | 1024 x 512 |
| 8 | 512 x 512 |
| 32 | 256 x 256 |

DIVISION NUMBER

| | |
|---|---|
| = 1 | |
| = 0 | |

NUMBER OF CELL USED

| ID | SIZE | POSITION A | POSITION B |
|---|---|---|---|
| 0 | 0 x 0 | (0, 0) | (0, 0) |
| 1 | 0 x 0 | (1024, 0) | (0, 0) |
| 2 | 0 x 0 | (0, 512) | (0, 0) |
| 3 | 0 x 0 | (1024, 512) | (0, 0) |
| 4 | 0 x 0 | (512, 0) | (0, 0) |
| 5 | 0 x 0 | (1536, 0) | (0, 0) |
| 6 | 0 x 0 | (512, 512) | (0, 0) |
| 7 | 0 x 0 | (1536, 512) | (0, 0) |
| ⋮ | ⋮ | ⋮ | ⋮ |
| 31 | 0 x 0 | (1792, 768) | (0, 0) |

MULTI-WINDOW DISPLAY APPARATUS FOR MANAGING WRITING FRAME MEMORY

This application is a continuation of application Ser. No. 08/334,073, filed Nov. 4, 1994, now abandoned.

BACKGROUND OF THE INVENTION

The present invention relates to window managing in a multi-window display apparatus.

A prior art multi-window display apparatus is illustrated in FIG. 1. The apparatus of FIG. 1 includes a writing portion 1, a window managing portion 2, an image transfer portion 3, a writing frame memory 4, a display frame memory 5, and a CRT display 6.

An application program designates a position (position B explained below), and a height and width of a window, to request acquisition of the window. The window managing portion 2 acquires a region in the writing frame memory 4 in accordance with the designated width and height of the window, and returns an identifier for the region to the application program. Here, the application program exists on the host side. Next, the application program in turn issues a request for writing to the apparatus by transferring figure data, including the window identifier, to the writing portion 1. The writing portion 1 writes the figure data in the writing frame memory 4 corresponding to the designated window identifier. After the figure data is written into the writing frame memory 4, the image transfer portion 3 copies the window region identified in the writing frame memory 4 into the display frame memory 5 in the position (position B) of the window. An image of the display frame memory 5 is displayed on the CRT display 6.

An example of window management performed in the prior art apparatus of FIG. 1 by the window managing portion 2 is illustrated in FIG. 2. Upon reception of the window acquisition request from the application program, the window managing portion 2 acquires a region of the designated width and height in the writing frame memory 4, such that the acquired region does not overlap any window already acquired. In a window control table, the designated width, height and position are described in the "width", "height" and "position B" columns of the table, and the position of the region acquired in the writing frame memory 4 is described in the "position A" column of the table. Thereafter, the "identifier" is returned to the application program.

When the window managing portion 2 receives a window resize request, the window managing portion 2 attempts to change the size of the region in the writing frame memory 4. If the size is decreased, only the width and height columns of the table are updated. If the size is increased, it is judged whether another window adjoins the region or not. When another window adjoins the region, a region having the designated size is acquired in another place in the writing frame memory 4.

When a window release request is received, the window managing portion 2 deletes the row of the window control table corresponding to the designated identifier.

The multi-window administration of the prior art has the following problems. Since windows are arranged irregularly in the writing frame memory 4, if the cycle of acquisition, resize and release is repeated, the number of unusable vacant regions increases, and the application efficiency of the memory deteriorates. When size increases occur due to resizing a window, the proximity of adjacent windows must be considered. As a result, processing efficiency deteriorates in accordance with the number of windows managed.

SUMMARY OF THE INVENTION

It is an object of the present invention to solve the above-described problems of the prior art.

It is therefore an object of the present invention to avoid deterioration of the application efficiency of memory even when the cycle of acquisition/release is repeated.

Moreover, it is another object of the present invention to realize resizing of windows easily without considering the state of the other windows.

The present invention is directed to a display apparatus which comprises a writing frame memory, divided into a plurality of cells, for storing a plurality of figure data, a display frame memory, coupled to said writing frame memory, for copying the data stored in the writing frame memory, a display, coupled to said display frame memory, for displaying an image based on the data copied in the display frame memory, a division table for storing a plurality of division data indicating a number of divisions of the writing frame memory and a maximum region size of the writing frame memory when the writing frame memory is divided into the number of divisions, a status table for storing a current number of divisions and a number of regions used to store current figure data, a cell table for storing a plurality of cell data indicating size of the figure data existing in each of the cells and cell positions in the writing frame memory, and figure managing means for managing the writing frame memory. The figure managing means comprises figure acquisition means responsive to reception of a figure acquisition request from an application program. When the number of cells in current use is less than the current number of divisions, the figure acquisition means updates the number of cells used in the status table, selects a vacant cell and updates the cell data size corresponding to the selected vacant cell under the condition that a designated size in the figure acquisition request is equal to or smaller than the maximum size of the current number of divisions.

BRIEF DESCRIPTION OF THE DRAWINGS

FIG. 5 is a diagram illustrating an example of a division table, a status table and a cell table under the initial condition in accordance with the present invention;

DETAILED DESCRIPTION OF THE PREFERRED EMBODIMENTS

Figure 1:
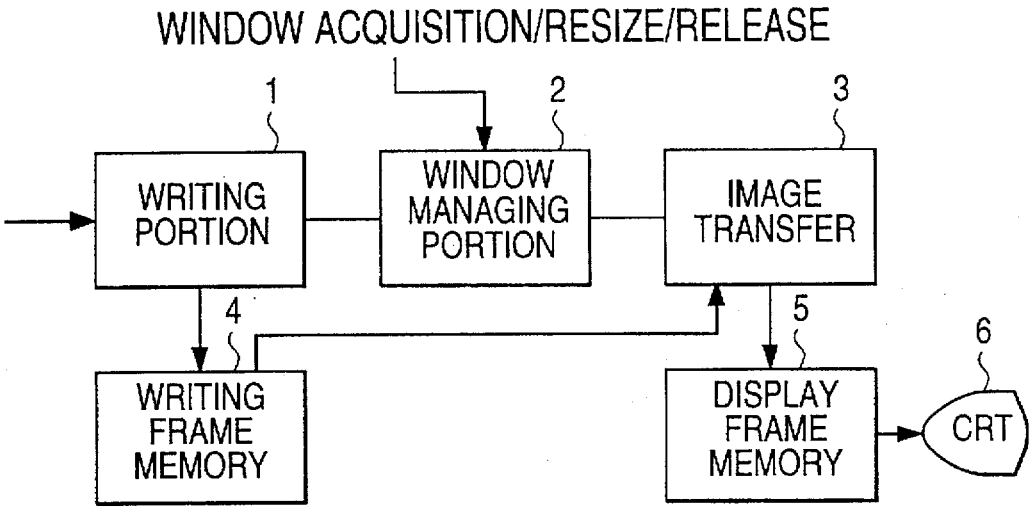
FIG. 1 (PRIOR ART)
FIG. 1 is a block diagram of a prior art multi-window display apparatus.
Figure 2:
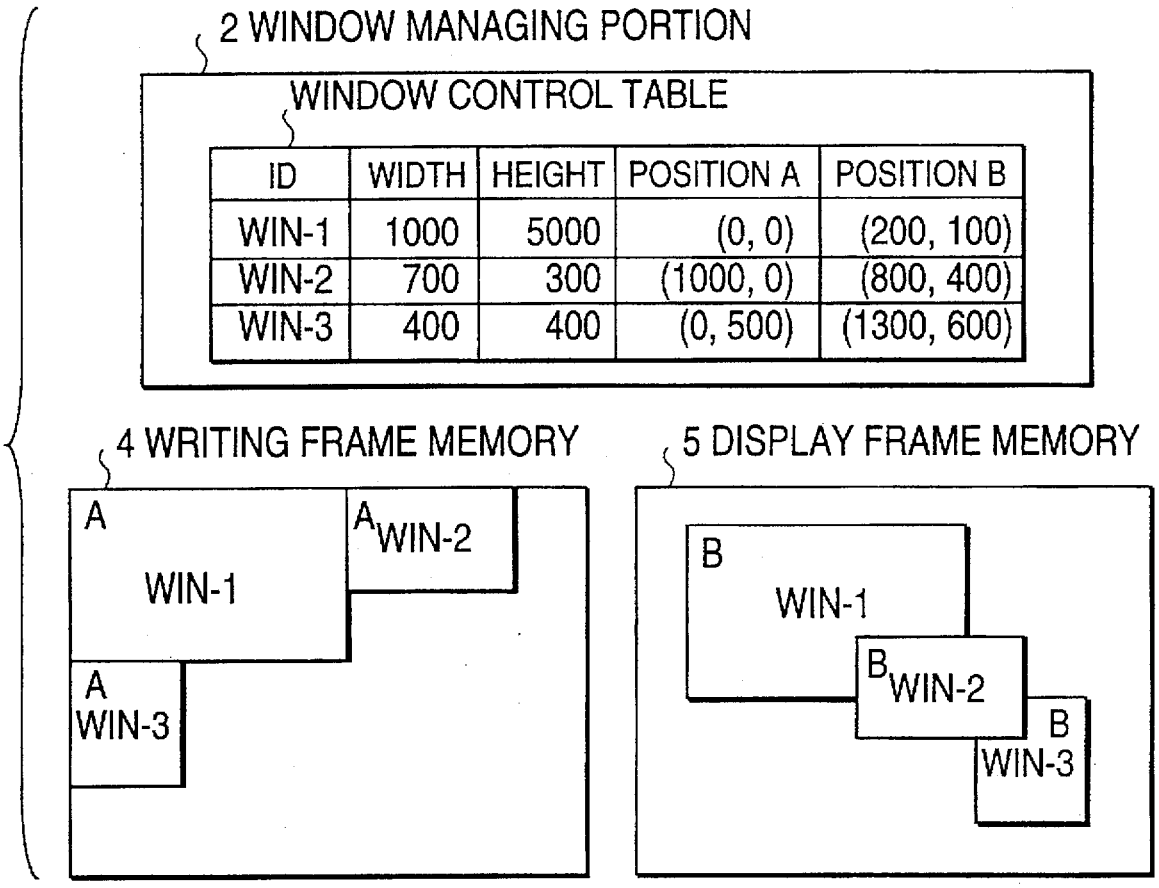
FIG. 2 (PRIOR ART)
FIG. 2 is a diagram of a conventional window managing portion.
Figure 3:
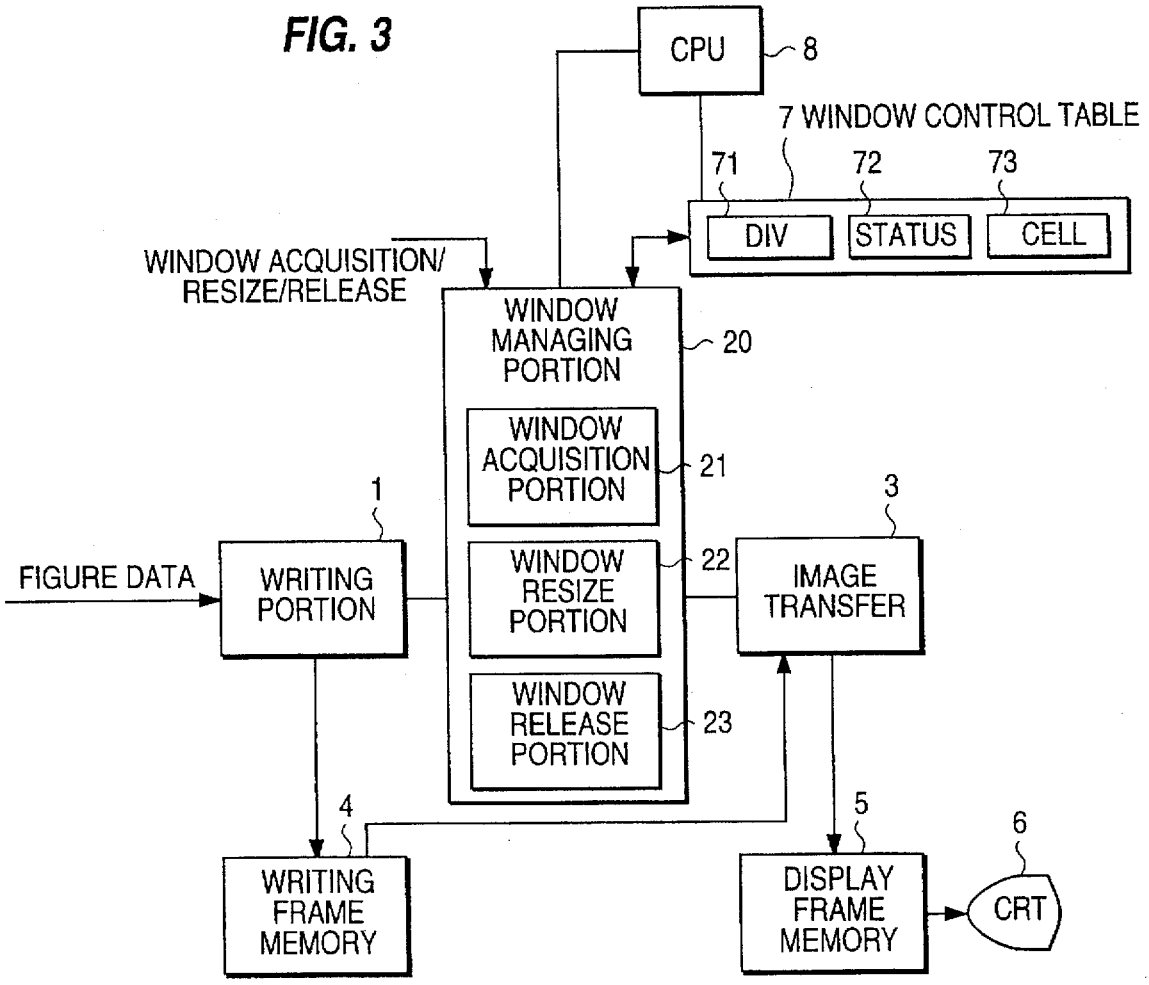
FIG. 3 is a diagram of a display apparatus in accordance with an embodiment of the present invention.

Referring to FIG. 3, the display apparatus of the present invention includes a writing portion 1, a window managing portion 20, an image transfer portion 3, a writing frame memory 4, a display frame memory 5, a CRT display 6, and a window control table 7. The window managing portion 20 has a window acquisition portion 21, a window resize portion 22 and a window release portion 23. The window control table 7 include a division table 71, a status table 72 and a cell table 73. A central processing unit 8 controls operation of the window control table 7 and the window managing portion 20.

The writing portion 1 writes figure data (e.g., window data) in the writing frame memory 4, corresponding to the designated window identifier. After the figure data is written into the writing frame memory 4, the image transfer portion 3 copies the window region on the writing frame memory 4 for writing on the display frame memory 5 for display in accordance with the window position. An image for display from the display frame memory 5 is displayed on the CRT display 6.

The division table 71 stores a plurality of division data. The division data indicate a number of divisions and a maximum size of a window region which can be acquired when the writing frame memory 4 is divided by the corresponding number of divisions. The status table 72 stores a current number of divisions or cells. Therefore, the status table 72 stores the number of cells currently being used. The cell table 73 stores cell data in the form of identifiers given to the cells, the size of window regions existing in the cells, and the positions of the cells in the writing frame memory 4. These three tables are explained in detail with reference to FIG. 4, FIG. 5 and FIG. 10.

The window managing portion 20 acquires a region of the writing frame memory 4 in order to store a window which an application program requests. The window managing portion 20 also resizes windows and releases a region of the writing frame memory 4 used for a window. To manage these three procedures, the window managing portion 20 has a window acquisition portion 21, a window resize portion 22 and a window release portion. 23. These three portions are described with reference to the flow charts of FIG. 7, FIG. 8 and FIG. 9.

The window acquisition portion 21 is responsive to reception of a window acquisition request. When the number of cells currently in use is less than the current number of divisions, the window acquisition portion 21 updates the number of cells used in the status table 72, selects a vacant cell, updates the size in the cell data corresponding to the selected vacant cell under the condition that a designated size in the window acquisition request is equal to or smaller than the maximum size of the current number of divisions. When the number of cells currently in use is not less than the current number of divisions, the window acquisition portion 21 updates the number of divisions of the status table 72, updates the number of cells used in the status table, selects a vacant cell, updates the cell data size corresponding to the selected vacant cell under the condition that the designated size of the window acquisition request and the sizes of all windows already acquired are less than the maximum size of the next largest number of divisions.

The window resize portion 22 is responsive to reception of a window resize request by the window managing portion 20. The window resize portion 22 updates the cell data size corresponding to the identifier designated by the window resize request when the size designated in the window resize request is equal to or less than the maximum size of the current number of divisions.

The window release portion 23 is responsive to reception of a window release request by the window managing portion 20. The window release portion 23 updates the size to zero in the cell data corresponding to the identifier designated by the window release request, subtracts one from the number of cells used, and sets the number of divisions in status table 72 to the smallest number of divisions when the number of cells used becomes 0. The present invention divides regularly the writing frame memory 4 as required into a plurality of cells to assign the divided cells to corresponding windows.

Figure 4A:
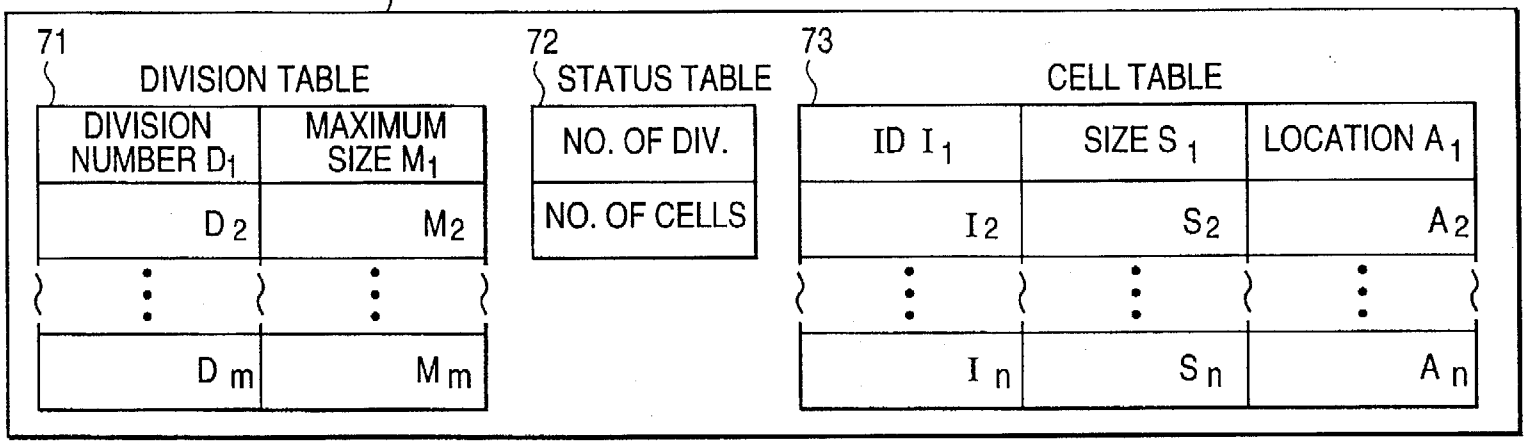
FIGS. 4(*a*), 4(*b*) and 4(*c*) are diagrams illustrating a preferred embodiment of the present invention.
Figure 4B:
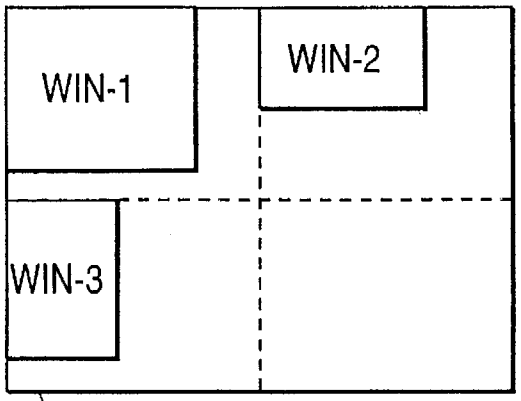
Figure 4C:
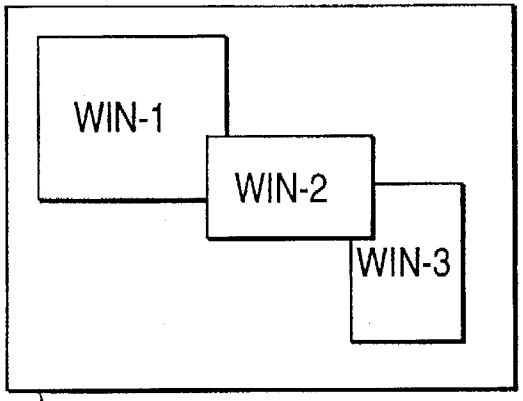

As shown in FIG. 4(*a*), the division table 71 indicates sizes (the maximum sizes of the window regions acquired for the corresponding number of divisions) of respective cells when the writing frame memory 4 is divided into several cells. For the initial condition, the number of divisions per frame D1 is 1 and the maximum size M1 (i.e., the width and height of the writing frame memory 4), is 2048×1024. Here, D1<D2<. . . <Dn. For example, the division number D2 corresponds to 2, the division number D3 corresponds to 4 and the division number Dm corresponds to 32.

The cell table 73 in FIG. 4(*a*) stores a plurality of cell data. Each item of cell data includes an identifier Ii (i is 1, 2, . . . , n) of a cell, a size Si (width and height) of a window existing in the cell, and a location Ai in the writing frame memory 4. When the size is (0×0), this indicates that a window does not exist in the cell. The status table 72 indicates the current number of divisions and the current number of cells being used. The diagram of writing frame memory 4 in FIG. 4(*b*) shows an example of a window arrangement in which three windows are acquired when the number of divisions is 4. The window acquisition process will now be explained. In general, the number of cells in use is equal to or less than the number of divisions. When the number of cells in use is less than the number of divisions, some cells are left unused under the current division number and therefore these unused cells are assigned to newly designated windows. When the number of cells in use is equal to the number of divisions, the division number is updated to the next division number, unused cells are generated and these cells are assigned to the newly designated windows. When the current number of divisions is Dk, the next number of divisions becomes Dk+1.

In the window resize process, the maximum size for the current division number is obtained from the division table 71. When the resize can be covered within the obtained maximum size, a cell data size corresponding to the identifier designated in the resize request is updated to the size designated in the resize request. In the window release process, the cell data size corresponding to the identifier designated in the window release request is set to (0×0) and one is subtracted from the number of cells in use as indicated by the status table 72. When the number of cells in use becomes 0, the number of divisions of the status table 72 is set to the number of divisions D1.

FIG. 5 illustrates examples of the division table 71, status table 72 and cell table 73 for the initial condition. The division table 71 has a plurality of rows and each row includes columns for storing the number of divisions and the maximum size. "1" is written in the first row of the division number column and "2048×1024" is written in the first row of the maximum size column. "2" is written in the second row of the division number column and "1024×1024" is written in the column for the maximum size. "4" is written in the third row of the division number column and "1024×512" is written in the third row of the maximum size column. "8" is written in the fourth row of the division number column and "512×512" is written in the fourth row of the maximum size column. "32" is written in the column for the number of divisions of the fifth row and "256×256" is written in the column for the maximum size. Here, it is assumed that the size of writing frame memory 4 is 2048×1024.

The status table 72 indicates the current number of divisions and the current number of cells used. In the example of FIG. 5, the first row is defined as the row for number of divisions and the second row as the row for the current number of cells used. In the initial condition, the number of divisions is set to 1, while the number of cells used is set to 0.

The cell table 73 has a plurality of rows. Each row includes columns for identifier, size, position A and position B. "0" is written in the identifier column of the first row, "0×0" is written in the size column, "(0,0)" is written in the position A column and "(0,0)" is written in the position B column. "1" is written in the identifier column of the second row, "0×0" is written in the size column, "(1024, 0)" is written in the position A column and "(0, 0)" is written in the position B column. "31" is written in the identifier column of the 32nd row, "0×0" is written in the size column, "(1792, 768)" is written in the position A column and "(0, 0)" is written in the position B column. In the initial condition, "0×0" is written in the size column of all rows in the cell table 73, while "(0, 0)" is written in the position B column of all rows in the cell table 73.

Figure 6:
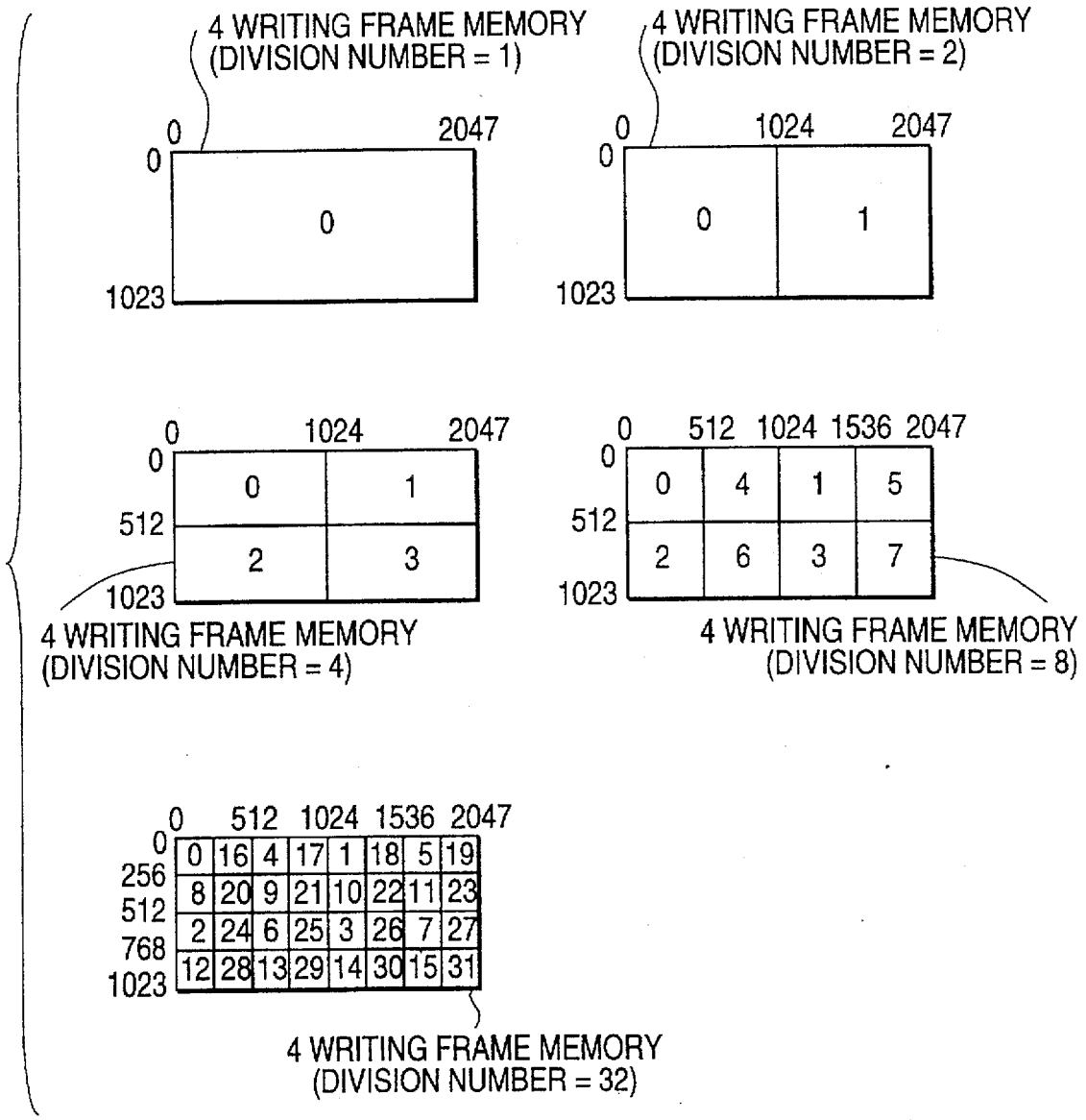
FIG. 6 is a diagram illustrating an example of the writing frame memory division in accordance with the present invention.

FIG. 6 is a diagram illustrating an example of divisions of the writing frame memory 4. When the number of divisions=1, the position of the cell (point in the upper left corner) is (0, 0), the size of the cell is 2048×1024 and the identifier of the cell is 0. When the number of divisions=2, the size of each cell is 1024×1024, the position of the cell having identifier=0 is (0, 0), while the position of the cell having identifier=1 is (1024, 0). When the number of divisions=4, the size of each cell is 1024×512, the position of the cell having identifier=0 is (0, 0), the position of the cell having identifier=1 is (1024, 0), the position of the cell having identifier=2 is (0, 512) and the position of the cell having identifier=3 is (1024, 512).

When the number of divisions=8, the size of each cell is 512×512, the position of the cell having identifier=0 is (0, 0), the position of the cell having identifier=1 is (1024, 0), the position of the cell having identifier=2 is (0, 512), the position of the cell having identifier=3 is (1024, 512), the position of the cell having identifier=4 is (512, 0), the position of the cell having identifier=5 is (1536, 0), the position of the cell having identifier=6 is (512, 512) and the position of the cell having identifier=7 is (1536, 512).

When the number of divisions=32, the size of each cell is 256×256, the position of the cell having identifier=0 is (0, 0), the position of the cell having identifier=1 is (1024, 0), the position of the cell having identifier=2 is (0, 512), the position of the cell having identifier=3 is (1024, 512), the position of the cell having identifier=4 is (512, 0), the position of the cell having identifier=5 is (1536, 0), the position of the cell having identifier=6 is (512, 512), the position of the cell having identifier=7 is (1536, 512), the position of the cell having identifier=8 is (0, 256), the position of the cell having identifier=9 is (512, 256), and the position of the cell having identifier=10 is (1024, 256). Thereafter, the positions are as indicated in FIG. 6.

Figure 7:
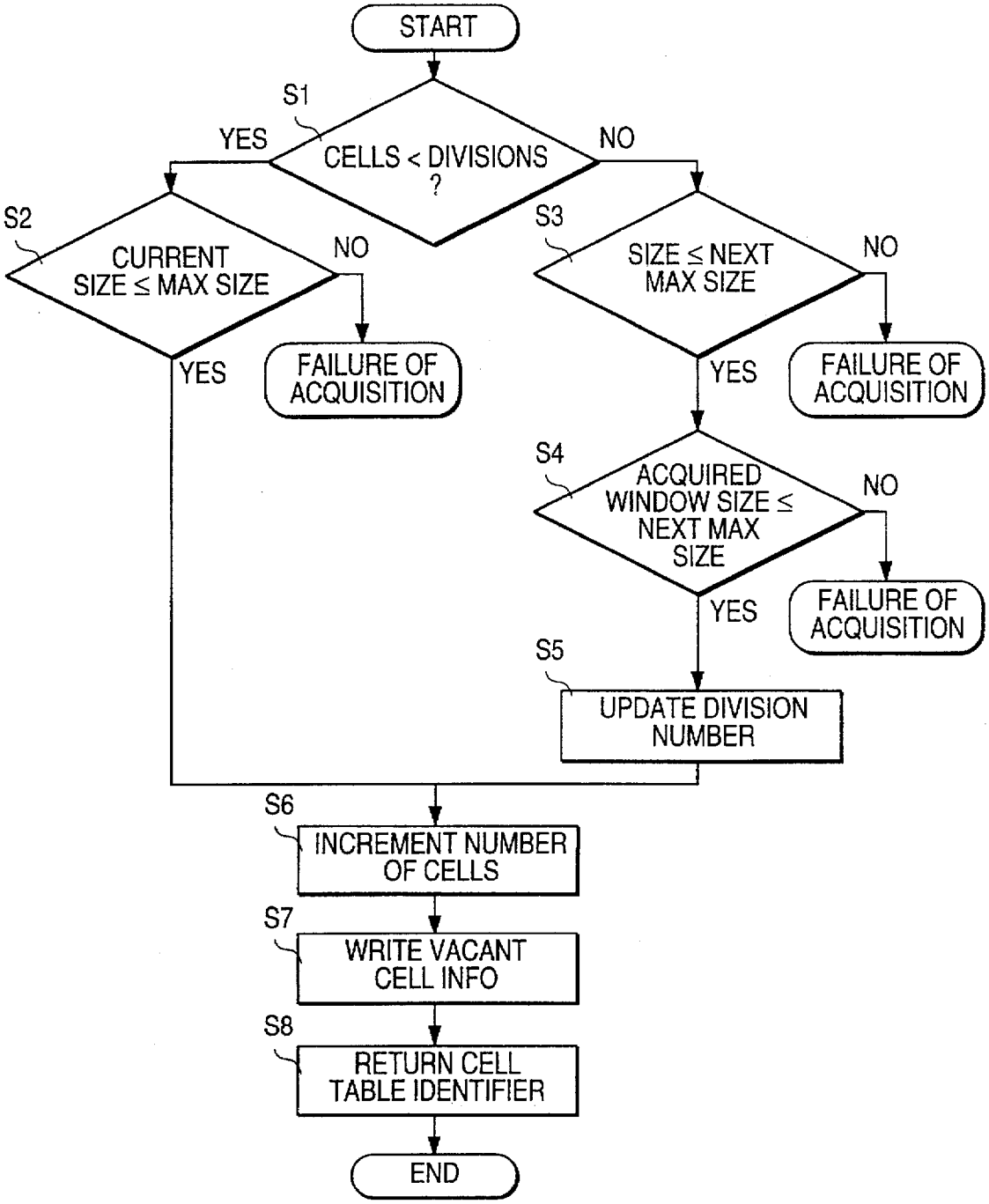
FIG. 7 is a flowchart of a window acquisition process in accordance with the present invention.

FIG. 7 is a flow chart of the window acquisition process 21 of FIG. 3. When a window acquisition request is received, the window managing portion 20 executes the processing explained below. The window acquisition request includes region height, region width and position in display frame memory 4 as the parameters. In step S1, it is checked by referring to the status table 72 whether the number of cells used is smaller than the number of divisions. When the judgement is YES, the processing proceeds to step S2. When the judgement is NO, the processing proceeds to step S3. In step S2, it is checked whether the designated size to be added by the acquisition request from the application program is equal to or smaller than the maximum size of the current number of divisions. When the judgement is YES, processing proceeds to step S6. When the judgement is NO, acquisition fails. In step S3, it is checked by referring to the division table 71 whether the designated size is equal to or smaller than the maximum size of the next number of divisions. When the judgement is YES, the processing proceeds to step S4. When the judgement is NO, acquisition fails. In step S4, it is checked whether the size of all windows already acquired is equal to or smaller than the maximum size of the next number of divisions. When the judgement is YES, the processing proceeds to step S5. When the judgement is NO, acquisition fails. In step S5, the number of divisions in the status table 72 is updated to the number of divisions in the next row, and in step S6, one is added to the number of cells in use in the status table 72. In step S7, one vacant cell is selected by referring to the cell table 73, the size designated in the window acquisition request is written into the size column for the row in the cell table corresponding to the selected vacant cell, and the position on the display frame memory 5 designated in the window acquisition request is written into the position B column. In step S8, an identifier of the row corresponding to the selected cell is obtained by referring to the cell table 73 and the identifier obtained is returned to the application program.

Figure 8:
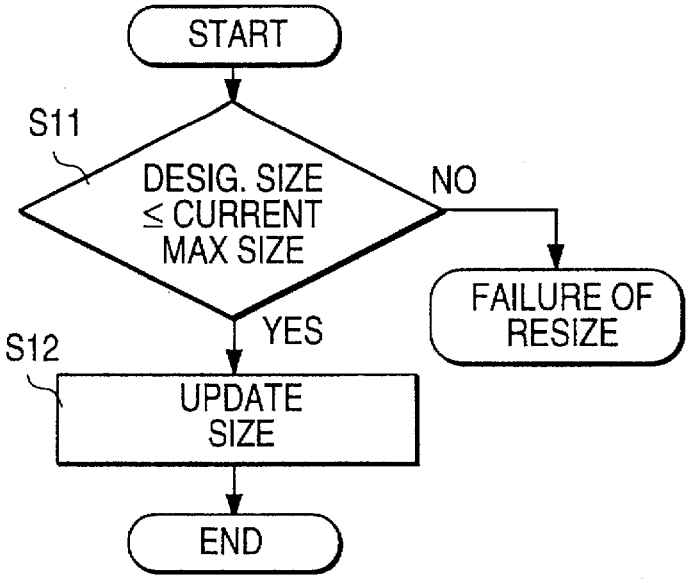
FIG. 8 is a flowchart of a window resize process in accordance with the present invention.

FIG. 8 is a flow chart of the window resize process 22. The window managing portion 20 executes; upon receipt of a resize request, the following processing. The resize request includes an identifier, region height and region width as the parameters. In step S11, it is checked whether the designated size to be added by the resize request from the application program is equal to or smaller than the maximum size of the current number of divisions. When the judgement is YES, the processing proceeds to step S12. When the judgement is NO, the resize process fails. In step S12, the size column for the row of the cell table 73 corresponding to the designated identifier, is updated.

Figure 9:
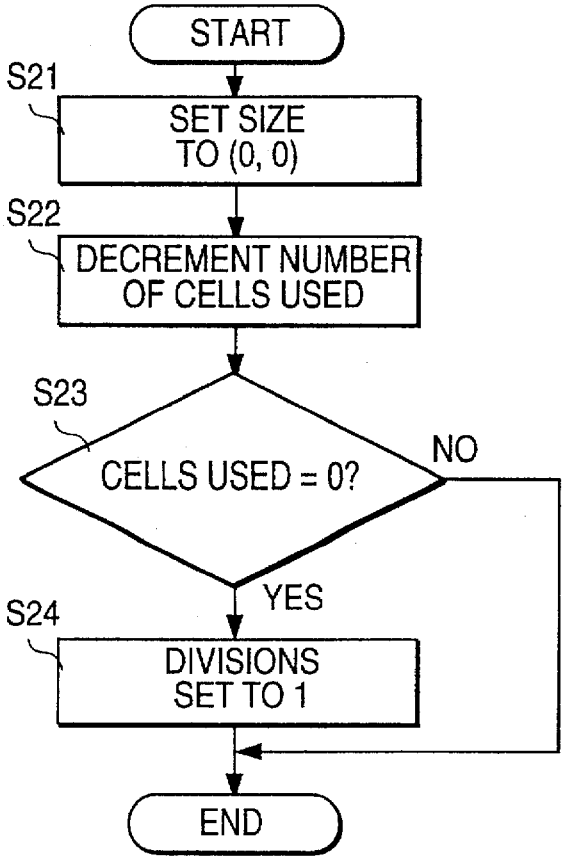
FIG. 9 is a flowchart of a window release process in accordance with the present invention.

FIG. 9 is a flowchart of the window release process 23. The window managing portion 20 executes, upon receipt of a release request, the processing explained below. The release request includes an identifier as a parameter. In step S21, 0×0 is written in the size column for the row in the cell table 73 corresponding to the identifier designated in the release request. In step S22, one is subtracted (−1) from "the number of cells used" in the status table 72, and in step S23, it is determined whether "the number of cells used"=0. When the judgement is YES, the processing proceeds to step 824. When the judgement is NO, the processing comes to an END. In step S24, the number of divisions in the status table 72 is set to 1.

Figure 10:
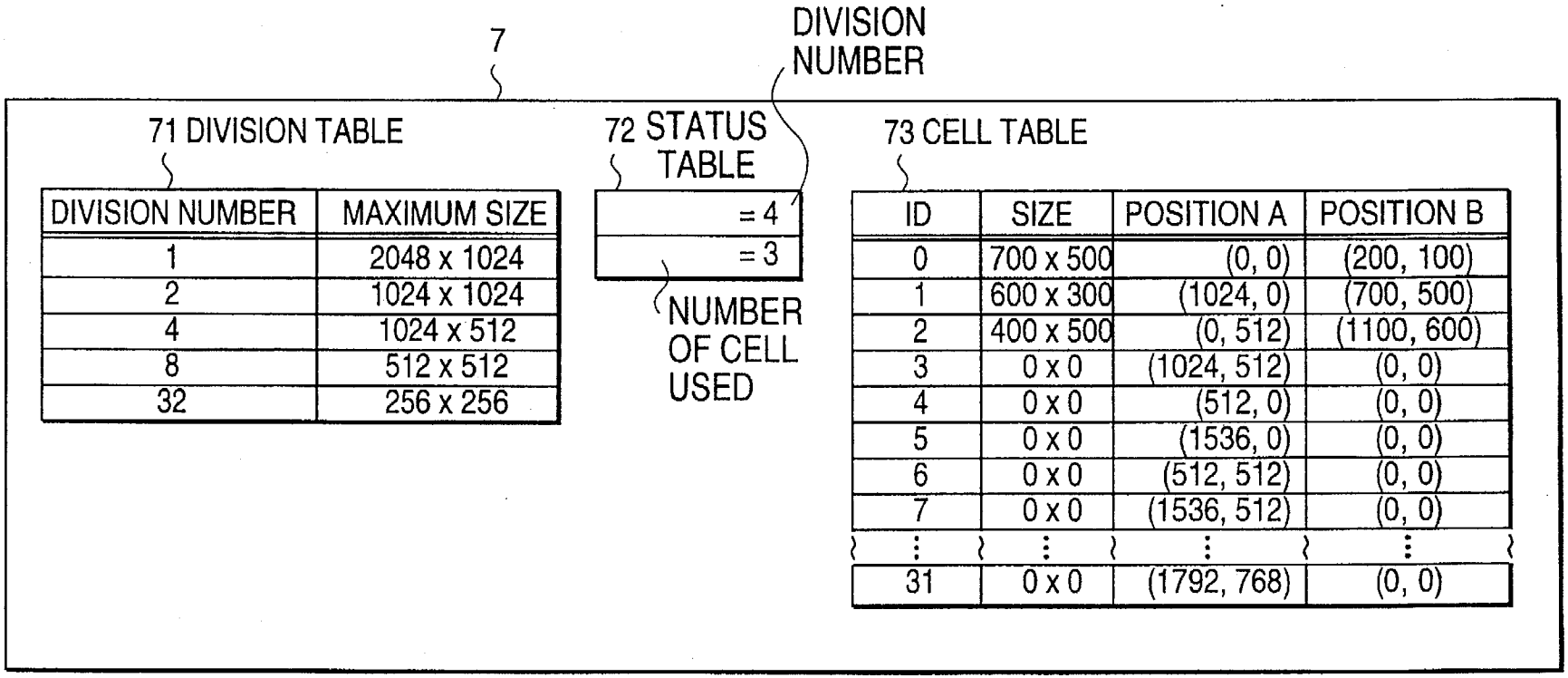
FIG. 10 is a diagram illustrating an example of contents of a division table, a status table and a cell table in accordance with the present invention when the number of divisions=4 and the number of cells used=3.
Figure 11:
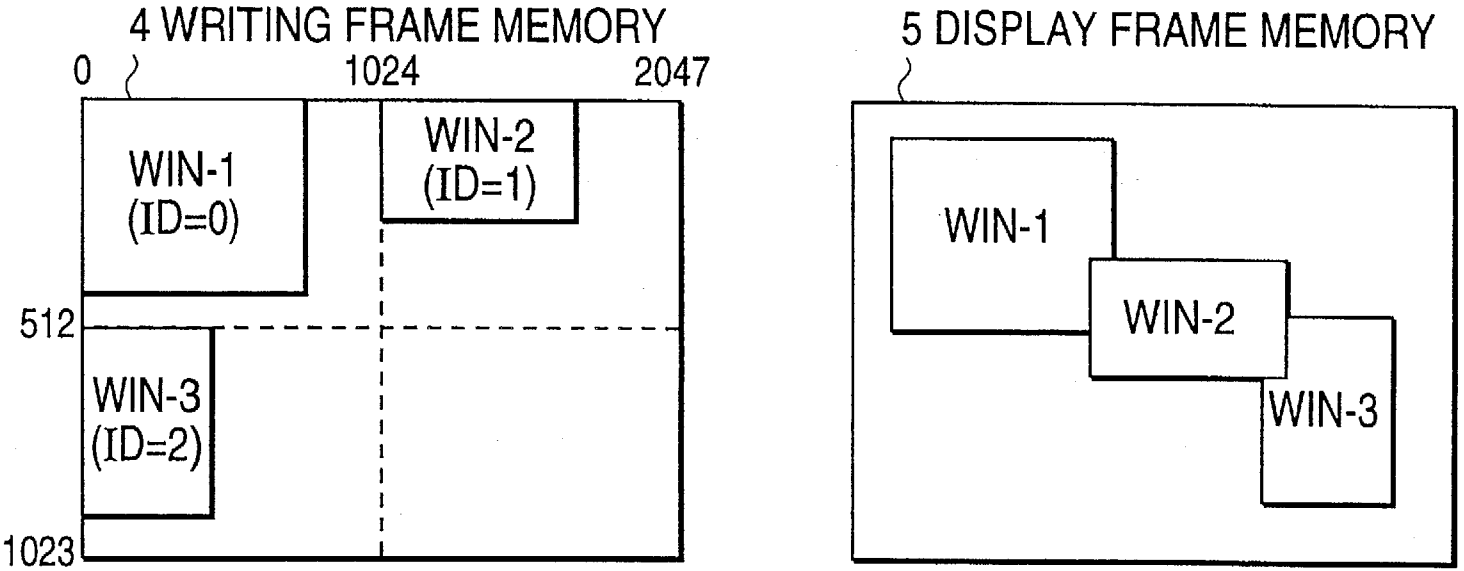
FIG. 11 is a diagram illustrating an example of the contents of a writing frame memory and a display frame memory in accordance with the present invention when the number of divisions=4 and the number of cells used=3.

FIG. 10 illustrates an example of the contents of the division table 71, status table 72 and cell table 73 when the number of divisions is 4 and the number of cells used=3. FIG. 11 illustrates an example of the contents of the writing frame memory 4 and display frame memory 5 when the number of divisions=4 and the number of cells used=3. Since "the number of divisions"=4 and "the number of cells used"=3, the "number of divisions"=4 is written in the first row of the status table 72 in FIG. 10, while "the number of cells used"=3 is written in the second row.

In the examples of FIG. 10 and FIG. 11, the cells with the identifiers=0, 1 and 2 are used. The window region existing in the cell with the identifier=0 has a size of 700×500, and the contents of this window region are copied to the position (200, 100) of the display frame memory 5. The window region existing in the cell with the identifier=1 has the size of 600×300, and the contents of this window region are copied to the position (700, 500) of the display frame memory 5. The window region existing in the cell with the identifier=2 has the size of 400×500, and the contents of this window region are copied to the position (1100, 600) of the display frame memory 5.

With reference to FIG. 10 and FIG. 11, the acquisition of memory for window 1 is explained in detail for the initial condition, the acquisition of the window 2 is explained for the condition that the window 1 is already acquired, and the acquisition of the window 3 is explained for the condition that the windows 1 and 2 are already acquired.

(1) Acquisition of the window 1

In the initial condition, since the number of cells used (=0) is equal to or less than the number of divisions (=1), a vacant cell in the current number of divisions is assigned. Since the cell 0 (ID=0) is vacant, a size of the window 1 (700×500) and position thereof on the display frame memory 5 (200, 100) are respectively written into the size column and the position B column of the row of the identifier 0 in the cell table 73. The number of cells used is updated to 1 in the status table 72.

(2) Acquisition of the window 2

Since the number of cells used (=1) matches the number of divisions (=1), transition to the next number of divisions is attempted. Since the size of the window 1 already acquired is equal to or less than the maximum size of the next number of divisions (=2), the number of divisions is set to 2. Next, a size of the window 2 (600×300) and position thereof on the display frame memory 5 ((700, 500) are respectively written into the size column, and the position B column of the vacant row of the identifier 1 in the cell table 73. The number of cells used is updated to 2 in the status table 72.

(3) Acquisition of the window 3

Since the number of cells used (=2) matches with the number of divisions (=2), transition to the next number of divisions is attempted. Since the sizes of the windows 1 and 2 which are already acquired are equal to or less than the maximum size (1024×512) of the next number of divisions (=4), the number of divisions is set to 4 in the status table 72. Next, the size of the window 3 (400×500) and position thereof in the display frame memory 5 (1100, 600) are respectively written in the size column and the position B column of the vacant row of the identifier 2 in the cell table 73. The number of cells used is updated to 3 in the status table 72.

As is clear from the above explanation, since the writing frame memory 4 is regularly divided in accordance with the number of windows acquired and the size of each window, the present invention provides the following advantages. The memory application efficiency is not lowered even if acquisition/release processes are repeated. Window resizing can be done without consideration of the existing windows, so long as the current number of divisions is within the maximum size.

The foregoing is considered as illustrative of the principles of the present invention. Since numerous modifications and changes will readily occur to those skilled in the art, it is not desired to limit the invention to the exact construction and applications shown and described, and accordingly, all suitable modifications and equivalents may be resorted to, as falling within the scope of the invention in the appended claims and their equivalents.

What is claimed is:

1. A display apparatus comprising:

a writing frame memory, having a memory area divided into a plurality of cell areas, for storing a plurality of figure data;

a display frame memory, coupled to said writing frame memory, for copying the figure data stored in said writing frame memory;

a display, coupled to said display frame memory, for displaying an image based on the figure data copied in said display frame memory;

a division table for storing a plurality of division data indicating a number of divisions of said writing frame memory and a maximum region size of said writing frame memory when said writing frame memory is divided into the corresponding number of divisions;

a status table for storing a current number of divisions and a number of regions used to store the figure data stored in said writing frame memory;

a cell table for storing cell data indicating a size of the figure data existing in each of the regions and locations of each region in said writing frame memory; and figure managing means for managing said writing frame memory, said figure managing means comprising figure acquisition means responsive to reception of a figure acquisition request from an application program, so that when the number of regions in current use is less than the current number of divisions, said figure acquisition means updates the number of regions used in the status table, selects a vacant region which corresponds to a selected one of the plurality of cell areas for storing figure data to be stored in said writing frame memory, compares the size of the figure data with the selected cell area, and updates the size in the cell data corresponding to the selected vacant region to allocate the figure data to the selected cell area under the condition that the size of the figure data is equal to or smaller than the maximum size of the selected cell area.

2. A display apparatus according to claim 1, wherein when the number of regions in current use is not less than the current number of divisions, said figure acquisition means updates the number of divisions in the status table, updates the number of regions used in the status table, selects a vacant region and updates the size of cell data corresponding to the selected vacant region under the condition that the designated size of the figure acquisition request and sizes of all regions already acquired are less than the maximum size of the next largest number of divisions.

3. A display apparatus according to claim 1 or 2, wherein said figure managing means further comprises figure resize means responsive to reception of a figure resize request designating an identifier and a size for updating the cell data corresponding to the identifier designated by the figure resize request when the size designated in the figure resize request is equal to or less than the maximum size for the current number of divisions.

4. A display apparatus according to claim 1 or 2, wherein said figure managing means further comprises:

figure release means responsive to reception of a figure release request designating an identifier, for updating the size to zero for the cell data corresponding to the identifier designated by the figure release request, subtracting one from the number of regions used and setting the number of divisions in said status table to a smallest number of divisions when the number of regions used becomes 0.

5. A method for managing a writing frame memory, comprising the steps of:

(a) receiving figure data from an application program;

(b) dividing a frame memory area of the writing frame memory into a plurality of cell areas of the writing frame memory;

(c) selecting one of the plurality of cell areas for storing the received figure data in the selected one of the cell areas of the writing frame memory;

(d) comparing the size of the received figure data with the size of the selected cell area of the writing frame memory;

(e) allocating the received figure data to the selected cell area of the writing frame memory when the size of the received figure data is less than or equal to the size of the selected cell area of the writing frame memory;

(f) displaying the stored figure data;

(g) storing a plurality of division data indicating a specified number of divisions and a corresponding maximum size of the cell when the writing frame memory is divided into the specified number of divisions;

(h) storing in a status table a current number of divisions and a current number of cells in use;

(i) storing in a cell table a plurality of cell data including identifiers specifying the cells, size of each cell and location of each cell in the writing frame memory;

(j) deciding whether the number of cells in current use is less than the current number of divisions; and (k) updating the number of cells used in the status table, selecting a vacant cell and updating the size of the cell data corresponding to the selected vacant cell based on said step (j).

6. A method for managing a writing frame memory according to claim 5, further comprising the step of:

(l) updating the number of divisions of the status table and the number of cells used of the status table, selecting a vacant cell and updating the size for the cell data corresponding to the selected vacant cell based on said step (j).

7. A method for managing a writing frame memory according to claim 6, wherein said step (d) comprises:

(d1) deciding whether a size designated in a figure resize request is equal to or less than the maximum size in the division table when the figure resize request is received, further comprising a step of:

(m) resizing the designated cell in the writing frame memory based on said step (d1).

8. A method of managing a writing frame memory according to claim 7, further comprising the steps of:

(n) updating to zero a size for the cell data corresponding to an identifier for which a figure release request is received;

(o) subtracting one from the number of cells used in the status table; and (p) setting the number of divisions of the status table to the smallest number of divisions when the number of cells used becomes zero.

9. A method for displaying figure data from an application program, comprising:

dividing a memory area of a writing frame memory into a plurality of cell areas of the writing frame memory;

selecting one of the plurality of cell areas of the writing frame memory for storing figure data to be stored in the writing frame memory;

comparing the size of the figure data with the size of the selected cell area of the writing frame memory;

allocating the figure data to the selected area of the writing frame memory when the size of the figure data is less than or equal to the size of the selected cell area of the writing frame memory;

storing window control information including division numbers, maximum sizes respectively corresponding to the division numbers, a current number of divisions, and a current number of cells storing figure data;

receiving a request to increase the number of cells storing figure data from the application program;

determining whether the number of cells can be increased based on a cell size of the request, cell sizes of the existing cells, the current number of divisions and the maximum sizes;

increasing the number of cells when it is determined that the number of cells can be increased based on said determining step; and generating a display based on the figure data corresponding to the increased number of cells.

10. A method as set forth in claim 9, wherein said determining step includes:

deciding whether the number of cells in current use is less than the current number of divisions; and updating the current number of cells and the size of the cell data corresponding to a selected vacant cell based on said deciding step.

11. A method as set forth in claim 9, further comprising:

deciding whether a size designated in a figure resize request is equal to or less than the maximum size for the corresponding division number when the figure resize request is received; and resizing the designated cell based on said deciding step.

12. A multi-window display apparatus, comprising:

a writing frame memory, having a memory area divided into a plurality of cell areas, to store a plurality of window data;

a display frame memory, coupled to said writing frame memory, to copy the window data stored in said writing frame memory;

a display, coupled to said display frame memory, to display an image based on the window data copied in said display frame memory;

a table to store data indicating a number of cells in said writing frame memory and a maximum size of a window region when the writing frame memory is divided into the corresponding number of cells; and a window managing portion to manage said writing frame memory, said window managing portion responsive to reception of a window acquisition request from an application program, so that when the number of cells currently in use is less than the current number of cells, said window managing portion updates a number of cells used, selects a vacant cell which corresponds to a selected one of the plurality of cell areas for storing window data to be stored in said writing frame memory, compares the size of the window data with the selected cell area, and updates the size corresponding to the selected cell to allocate the window data to the selected cell area when the size of the window data is less than or equal to the maximum size of the selected cell area.

13. A multi-window display apparatus according to claim 12, wherein when the number of cells currently in use is not less than or equal to the current number of cells, said window managing portion increases the number of cells, selects a vacant cell and updates the size of the selected vacant cell so that the designated size of the window acquisition request and the sizes of all regions already acquired are less than the maximum size of the next largest number of cells.

14. A method for generating a multi-window display, comprising the steps of:

receiving window data from an application program dividing a frame memory area of a writing frame memory into a plurality of cell areas;

selecting one of the plurality of cell areas for storing the received window data in the selected one of the cell areas;

comparing the size of the window data with a size of the selected cell area;

allocating the window data to the selected cell area when the size of the window data is less than or equal to the size of the selected cell area of the writing frame memory;

displaying the allocated window data; and modifying the number of cells into which the frame memory is divided based on a window management request from an application program, so as to increase the number of cells into which window data may be stored without any overlap between the windows.

* * * * *

UNITED STATES PATENT AND TRADEMARK OFFICE

CERTIFICATE OF CORRECTION

PATENT NO. : 5,720,016

DATED : Feb. 17, 1998

INVENTOR(S) : EGASHIRA

It is certified that error appears in the above-identified patent and that said Letters Patent is hereby corrected as shown below:

TITLE PAGE: [73] Assignee: change "Kanagawa" to --Kawasaki--.

Col. 6, line 65, change "824" to --S24--.

Col. 7, line 46, change "((" to --(--.

Signed and Sealed this

Thirtieth Day of June, 1998

*Attest:*

*Attesting Officer*

BRUCE LEHMAN

*Commissioner of Patents and Trademarks*